United States Patent [19]

Denier et al.

[11] Patent Number: 4,696,456

[45] **Date of Patent: * Sep. 29, 1987**

[54] METHOD OF IMPROVING PERMEABILITY OF METALLURGICAL VESSELS, AND MATERIAL FOR IMPLEMENTING THE SAME

[75] Inventors: Guy Denier, Metz, France; Romain Henrion, Esch, Luxembourg

[73] Assignees: Institut de Recherches de la Siderurgie Francaise, Metz, France; Arbed S/A, Luxembourg, Luxembourg

[ * ] Notice: The portion of the term of this patent subsequent to Sep. 1, 2004 has been disclaimed.

[21] Appl. No.: 486,845

[22] Filed: Apr. 20, 1983

[30] Foreign Application Priority Data

Apr. 22, 1982 [FR] France ..... 82 07117

[51] Int. Cl.[4] ..... C21C 5/44

[52] U.S. Cl. ..... 266/44; 266/281; 264/30

[58] Field of Search ..... 266/44, 280, 281, 246; 75/52, 60; 264/30

[56] References Cited

U.S. PATENT DOCUMENTS

| | | | |
|---|---|---|---|
| 3,259,484 | 7/1966 | Leroy et al. | 75/52 |
| 4,294,431 | 10/1981 | Steen et al. | 266/44 |
| 4,298,378 | 11/1981 | Murakami | 266/246 |
| 4,410,167 | 10/1983 | Murakami | 75/60 |

FOREIGN PATENT DOCUMENTS

| | | |
|---|---|---|
| 0021861 | 4/1980 | European Pat. Off. . |

*Primary Examiner*—Melvyn J. Andrews
*Assistant Examiner*—S. Kastler
*Attorney, Agent, or Firm*—Michael J. Striker

[57] ABSTRACT

For improving permeability of a metallurgical vessel bottom provided with permeable refractory elements for controlled injection of a stirring fluid into a molten metal bath, the metallurgical vessel is emptied of its contents, a castable composed of a refractory material compatible with the refractory material of the bottom is deposited in the bottom and spread over the latter, and the castable is left to dry and set, while maintaining in the permeable refractory elements a sufficient pressure to provide a permanent flow of a stirring fluid. A hydraulic magnesian refractory castable used in this method has a content of water of substantially between 8 and 10% by weight.

3 Claims, No Drawings

METHOD OF IMPROVING PERMEABILITY OF METALLURGICAL VESSELS, AND MATERIAL FOR IMPLEMENTING THE SAME

CROSS-REFERENCE TO A RELATED APPLICATION

Application Ser. No. 052,755 which is a continuation of the present applicaton and which has claims of a different scope has been filed on May 5, 1987.

BACKGROUND OF THE INVENTION

The present invention relates to metal production, particularly steel. More precisely it relates to metallurgical vessels such as refining converters with bottoms provided with permeable refractory elements.

Metallurgical processes are known in which a molten metal bath is subjected to pneumatic stirring or bubbling by controlled injection of a stirring fluid, usually an inert gas such as nitrogen or argon, through permeable refractory elements incorporated in the usual refractory lining of the vessel which contains the bath. The injected inert gas emerges under the surface of the bath contained in the vessel. The abovementioned permeable refractory elements for blowing the inert gas are in general provided in the bottom of the vessel, as disclosed for example in the French Pat. No. 2,322,202 or U.S. Pat. No. 3,259,484. The steel-making process which includes this stirring technique and blowing of refining oxygen through the top of the vessel is used at the present time throughout the world and known under the commercial name "LBE process" (Lance-Brassage-Equilibre). This process tends to provide, as its name indicates, a balance between metal and slag, so as to accumulate to a large extent the respective advantages of the conventional top oxygen blowing and bottom oxygen blowing refining processes.

Numerous solutions have been proposed for providing in the refractory elements sufficient selective permeability so as to produce a satisfactory flow of stirring fluid and at the same time avoid penetration of the molten metal in the reverse direction. One of these solutions is described in the published European patent application No. 21,861 and consists in forming passage zones of very small size in a usual compact refractory material. This is obtained either by incorporating longitudinal (in blowing direction) foreign bodies within a monolithic refractory mass, or by juxtaposing refractory plates with interposition of calibrated distance pieces therebetween. These elements like any refractory material inevitably wear out as a result of their contact with the molten metal. This wear is accelerated because of the gas blast which causes substantial convection movements at the level of the blowing elements and whose induced effects are felt also on the service life of the surrounding conventional refractory. At the present time it is however possible with the elements of the above mentioned type to limit the rate of wear thereof substantially to the wear of the conventional refractory lining which forms the bottom, so as to have a service life comparable with the service life in the conventional top oxygen blowing converters of LD type. Another problem which arises in practice is that the permeability of the blowing elements tends to diminish during use. This phenomenon seems somewhat paradoxical, since it accompanies the normal progressive wear of the bottom and therefore it might be thought that because the elements wear out at practically the same rate as the bottom, their permeability should to the contrary increase with time, following a reduction of the pressure losses in the blowing spaces. However in practice the permeability of the blowing elements substantially diminishes during use, and unless they are frequently replaced their permeability no longer allows the desired gas flow to pass therethrough. This is not only highly disadvantageous, but also takes away all advantages obtained by a service life of the elements equal to the service life of the bottom.

SUMMARY OF THE INVENTION

Accordingly, it is an object of the present invention to provide a method of improving permeability of a metallurgical vessel which avoids the disadvantages of the prior art.

More particularly, it is an object of the present invention to provide a method which allows an increase in the permeability of the blowing refractory elements in a simple, effective and inexpensive manner, without acting directly on these elements, and without replacing them by new elements.

In keeping with these objects and with others which will become apparent hereinafter, one feature of the present invention resides, briefly stated, in a method of improving permeability of a metallurgical vessel bottom provided with permeable refractory elements for controlled injection of a stirring fluid into a molten metal bath, in accordance with which the metallurgical vessel is emptied of its contents, a castable composed of refractory material compatible with the refractory material of the bottom is deposited onto the bottom and spread thereover, and the castable is left to dry and set, while maintaining in the permeable refractory elements a sufficient pressure to provide a permanent flow of a stirring fluid.

A further feature of the present invention is that a hydraulic magnesian refractory castable is provided for implementing the method, which comprises a content of water of substantially between 8 and 10% by weight.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

For improving permeability of a bottom in a metallurgical vessel, particularly a steel-making converter with refining oxygen blown through the top and with the bottom provided with permeable refractory elements for controllably inducing a stirring liquid into the molten metal bath, the vessel is first emptied of its contents after refining a charge. Then a castable made from a refractory material compatible with the refractory material which forms the bottom is placed in the bottom. The castable has a sufficient fluidity to spread over the bottom. After this, the castable is left to dry and set, while maintaining in the permeable refractory elements sufficient pressure to provide a permanent flow of stirring fluid. For example, in the case of a converter of a capacity exceeding 200 t, the pressure may be maintained in the elements providing a fluid flow rate on the order of about 30 $m^3/h$ per element.

In accordance with a preferred embodiment of the present invention, the readily flowable refractory castable is capable of reaching the bottom of the vessel from a nose by flowing along a side wall. This castable is poured into the vessel through the nose when the vessel is in an inclined position, for example in a position intermediate between its upright position and its completely tipped position which is present at the end of casting of the molten metal. Then the vessel is brought upright again to distribute the castable over the bottom, and the castable is left to dry and set, while maintaining in the permeable refractory elements a sufficient pressure to ensure a stirring fluid flow.

The vessel may be tipped on each side from its upright position so as to improve spreading of the castable over the bottom. While the metallurgical vessel described is a refining converter with oxygen blown through the top by means of an emerged vertical nozzle, it is of course understood that the invention can also be applied to any other metallurgical vessel, for example ladles or arc furnaces. The term "castable" means not only the traditional cold-setting hydraulic concretes with a temperature of use less than 100° C., but also tarred refractory products, such as for example tarred dolomite and magnesia oxide with a "carbon-bond" and used between approximately 130° and 180° C.

The expression "a castable made from a refractory material compatible with the refractory material forming the bottom" means any refractory material which, taking into consideration the nature of the bottom, is capable of adhering to the latter during solidification. For example, if the bottom is composed predominantly of magnesia, a magnesia castable is used, when the bottom has a dolomite basis a dolomitic castable is used, etc.

The expression "readily flowable castable" means a preparation of the castable which makes it more fluid than the fluidity which would result from a preparation made according to the directions given by the concrete manufacturer. In other words, it is generally a question of making the castable (concrete) moister, that is to contain an excess of water with respect to the usual directions, so as to reach a content of water on the order of 10% by weight. It is of course to be understood that the more the water is in excess, the longer the drying time will be.

On the other hand, the lower limit of the fluidity rate to be adopted must take into account the capacity or size of the vessel, particularly its height and the diameter of the bottom, as well as its thermal mass. These parameters must be taken into consideration so that, when the castable is introduced through the open upper end (nose) of the vessel, it can reach the bottom and spread on the bottom before solidifying.

By way of example, a series of tests made on a 240 t converter has shown that the water content is preferably between 8 and 10% by weight, or in other words by 1 to 2 points more than is recommended as a maximum by the manufacturer. Usually the recommendation is to provide up to 7% of water content by weight, more usually between 3 and 6%.

Three examples of ponderal compositions are presented hereinbelow for the castables usable in accordance with the invention. The first two compositions are for covering a converter bottom made from magnesia bricks, and the third composition is provided for a dolomitic bottom.

EXAMPLE 1

Hydraulic magnesian castable

MgO: 97.3% of the weight of the aggregate (solids)
CaO: 1.0% of the weight of the aggregate (solids)
$SiO_2$: 0.4% of the weight of the aggregate (solids)
$R_2O_3$: 1.3% of the weight of the aggregate (solids)
$H_2O$: 8 to 10% of the weight of the castable
where $R_2O_3$ represents the whole of the oxides present of metals such as Al; Ti, Cr . . . .

EXAMPLE 2

Tarred magnesian castable

MgO: 90% of the weight of the aggregate (solids)
CaO: 2% of the weight of the aggregate (solids)
$SiO_2$: 1% of the weight of the aggregate (solids)
$Fe_2O_3$: 3% of the weight of aggregate (solids)
Tar: 10% of the weight of the castable

EXAMPLE 3

Tarred dolomitic castable

MgO: 41% of the weight of the aggregate (solids)
CaO: 57% of the weight of the aggregate (solids)
$Fe_2O_3$: 0.6% of the weight of the aggregate (solids)
$Al_2O_3$: 0.5% of the weight of the aggregate (solids)
$SiO_2$: 0.7% of the weight of the aggregate (solids)
Tar: 10% of the weight of the castable As can be seen, the method of improving permeability in accordance with the present invention is simple, inexpensive and poses no problems which cannot be overcome. The presence of permeable refractory elements in the bottom of the converter implies no other requirements during drying of the castable than that which includes the maintaining of a minimum flow of stirring fluid through the bottom, which flow may be qualified as "safety flow" and which moreover takes place during the down time.

This flow, which may be considered as lost since it is unused for treating the bath, increases the overall cost of the operation only very little, since its value is relatively low with respect to that used during stirring of the bath, on the order of 150 $m^3/h$ per element. The consequences on the cost may be considered as practically negligible, if care is taken to choose a readily available gas, such as for example nitrogen, or even a recovered gas produced in the works itself, such as $CO_2$.

When the castable is dried, it is mechanically set on the bottom and forms a refractory layer which can reach in its central zone an average thickness of between about 5 and 20 cm, in a 240 t converter. The converter is now ready for treating new charges. It can be seen from the first charge treated that not only is the permeability of the bottom preserved, but it is substantially increased with respect to the level that it had before adding the castable.

A possible indicator of the permeability level may be formed by the pressure/flow rate ratio of the stirring fluid in the duct conveying the latter to the permeable refractory elements. This ratio may be normalized by its reference value, the permeable element being taken in the new condition with off-load blowing or during refining of the first charge in the converter.

The results obtained from the method in accordance with the present invention are unexpected, surprising and not yet fully clear. The observations conducted seem to show that the preservation of the permeability is ensured by the presence of a network of channels connecting the blowing face of the element to the free surface at the bottom through the added castable layer. This network is formed during drying of the layer because of the permanent stirring of the stirring fluid.

As for the improvement of the permeability, it may be a question of a phenomenon internal to the permeable refractory element itself. It may be thought that the origin is probably to be found in the thermal shock effects caused within the blowing elements by casting the mass of cold castable with temperature less than 100° C. or about 200° C. depending on the nature of the castable, and further amplified by the permanent flow of the stirring fluid. It may be assumed that the thermal stresses which result therefrom within the blowing elements by contraction of the material causes, when released, the formation of micro-cracks beginning preferentially in the wall of the original passages provided for the stirring fluid.

These assumptions are based on the fact that a statistically greater improvement in the permeability of these elements is noted when the whole mass of liquid castable intended to cover the bottom is poured rapidly at one introduction into the vessel. This method forms a preferred embodiment of the present invention.

On the other hand, it has been noted that, considering the large thermal mass of the bottom, the temperature of the added castable has no appreciable influence on the permeability.

A purely mechanical explanation may also be conjectured, the stirring fluid being able to flow in part laterally in the lower pressure loss zones which may possibly be formed at the interface of the deposited castable layer and the already existing refractory bottom.

The method in accordance with the present invention may be used at any time, not only between two refining runs, but also between two charges of the same run, or even before the first charge, on a converter in a new condition. It is also to be understood that the invention also provides repair or renewal of worn bottoms.

The method in accordance with the present invention may be applied regardless of the type of permeable refractory elements provided in the bottom. It must be emphasized that excellent results are obtained with the above mentioned elements, and further details of which may be found in the description of the European patent application No. 21,862.

It will be understood that each of the procedural steps described above, or two or more together, may also find a useful application in other types of methods differing from the types described above.

While the invention has been illustrated and described as embodied in a method of improving permeability of a metallurgical vessel and a material provided therefor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of improving permeability of the bottom of a metallurgical vessel provided with permeable refractory elements for controlled injection of a stirring fluid into a molten metal bath, comprising the steps of emptying a metallurgical vessel of its contents; depositing onto the bottom of the vessel a hydraulic magnesian refractory castable compatible with the material of the bottom, this castable comprising a content of water substantially between 8 and 10% by weight to provide a sufficient fluidity which insures spreading thereof over the bottom of the vessel and leaving the castable to dry and set, while maintaining in the permeable refractory elements a sufficient pressure to insure a permanent flow of the stirring fluid approximately 30 $m^3/h$ per refractory element.

2. A method as defined in claim 1, wherein said depositing and spreading step includes providing such a castable which is readily flowable and capable of reaching the bottom of the vessel from a nose by flowing along a lateral wall, pouring the castable into the vessel through the nose, maintaining the vessel in tipped position while pouring the castable, then bringing the vessel back to an upright position to ensure distribution of the castable over the bottom of the vessel.

3. A method as defined in claim 1, and further comprising the step of rocking the vessel, after said pouring step, to each side from its upright position so as to improve the spreading of the castable over the bottom of the vessel.

* * * * *